US006330720B1

(12) United States Patent
Steelman

(10) Patent No.: US 6,330,720 B1
(45) Date of Patent: Dec. 18, 2001

(54) CONVERTIBLE GARMENT

(76) Inventor: Clifton V. Steelman, P.O. Box 1457, Prosser, WA (US) 99350-0800

( * ) Notice: Subject to any disclaimer, the term of this patent is extended or adjusted under 35 U.S.C. 154(b) by 10 days.

(21) Appl. No.: 09/624,094

(22) Filed: Jul. 24, 2000

(51) Int. Cl.[7] ..... A41D 15/04
(52) U.S. Cl. ..... 2/93; 2/102
(58) Field of Search ..... 2/93, 85, 86, 94, 2/95, 96, 97, 102, 103, 69.5, 79; D2/828, 829, 830, 831

(56) References Cited

U.S. PATENT DOCUMENTS

| | | | | |
|---|---|---|---|---|
| D. 270,585 | * | 9/1983 | Viio | D2/184 |
| D. 385,688 | * | 11/1997 | Clausell | D2/831 |
| 2,437,223 | * | 3/1948 | Dutrow | 2/4 |
| 2,678,447 | * | 5/1954 | Bracken | 2/94 |
| 3,389,407 | * | 6/1968 | Morrison | 2/84 |
| 4,103,377 | * | 8/1978 | Mayer et al. | 5/343 |
| 4,149,272 | | 4/1979 | Maeshima | 2/102 |
| 4,154,323 | * | 5/1979 | Sneider | 190/2 |
| 4,158,892 | * | 6/1979 | Gonzales | 2/69.5 |
| 4,575,876 | * | 3/1986 | Weaver | 2/69.5 |
| 4,669,127 | * | 6/1987 | Swanson | 2/46 |
| 4,700,409 | * | 10/1987 | De Lott | 2/94 |
| 4,932,574 | | 6/1990 | Doshi | 224/153 |
| 5,033,127 | | 7/1991 | Schmeltz | 2/269 |
| 5,077,838 | * | 1/1992 | Senser | 2/69 |
| 5,101,514 | * | 4/1992 | Eklund | 2/94 |
| 5,195,187 | * | 3/1993 | Yang | 2/102 |
| 5,361,412 | | 11/1994 | Perry | 2/69 |
| 5,560,043 | * | 10/1996 | Armstrong | 2/69.5 |
| 5,570,473 | * | 11/1996 | Andries | 2/93 |
| 5,718,000 | * | 2/1998 | Ost et al. | 2/69 |
| 5,785,219 | * | 7/1998 | Kraft | 224/576 |
| 5,815,833 | * | 10/1998 | Kuo | 2/69.5 |
| 5,918,312 | * | 7/1999 | Craren | 2/69 |
| 6,061,831 | * | 5/2000 | Rudolph et al. | 2/69.5 |

* cited by examiner

*Primary Examiner*—John J. Calvert
*Assistant Examiner*—Alissa Hoey
(74) *Attorney, Agent, or Firm*—Liebler, Ivey & Connor; Floyd E. Ivey

(57) ABSTRACT

An apparatus or article of manufacture composing a jacket, vest, coat, shirt or similar clothing article which is convertible into a covering or blanket. The jacket or vest is assembled with a pocket formed between a portion of the jacket, such as a jacket outer covering, and a portion of a blanket wherein a portion of the blanket is foldably received into and stored within a pocket for removal and unfolding when use of the blanket is required. The pocket may be at any location on the jacket including at the front, back and inside. The manufacture of the vest or jacket is principally a blanket or fabric unit or portion integral with the vest or jacket portion. The blanket or fabric portion is contained, by folding, in the pocket. The vest or jacket is worn and utilized as any jacket or vest garment.

20 Claims, 15 Drawing Sheets

CONVERTIBLE GARMENT

FIELD OF THE INVENTION

The present invention relates generally to an apparatus or an article of manufacture of clothing and more particularly an article of clothing which may be converted or unfolded into a bed roll, blanket or covering.

BACKGROUND OF THE INVENTION

Articles of clothing providing multiple features are known in the art. U.S. Pat. No. 4,149,272 to Maeshima discloses a multi-purpose vest with a pocket suitable for containing items such as a waterproof jacket. U.S. Pat. No. 4,932,574 to Doshi illustrates a garment folded into a bundle which may be carried as a backpack. U.S. Pat. No. 5,361,412 to Perry discloses a multi-use vest with several configurations of pockets. The foregoing are provided herewith in an Information Disclosure Statement in accordance with 37 CFR 1.97.

SUMMARY OF THE INVENTION

The present invention discloses a jacket, vest, coat, shirt or similar clothing article which converts or unfolds into a bed roll, covering or blanket to provide sleeping support or overall body coverage and comfort. The disclosed jacket or vest is assembled with a pocket formed between a portion of the jacket, such as a jacket outer covering, and a portion of a blanket wherein a portion of the blanket is foldably received into and stored within the pocket for removal and unfolding when use of the blanket is required. The pocket thus formed may be at any location on the jacket including but not limited to the front, back and inside of the vest or jacket. The manufacture of the vest or jacket is principally a blanket or fabric unit or portion integral with the vest or jacket portion. The blanket or fabric portion is contained, by folding, in the pocket. The vest or jacket is worn and utilized as any jacket or vest garment. The integral blanket or fabric portion may be removed from the pocket and unfolded forming, with the vest or jacket portion and the primary area of the blanket or fabric, generally a blanket, comforter or other covering.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
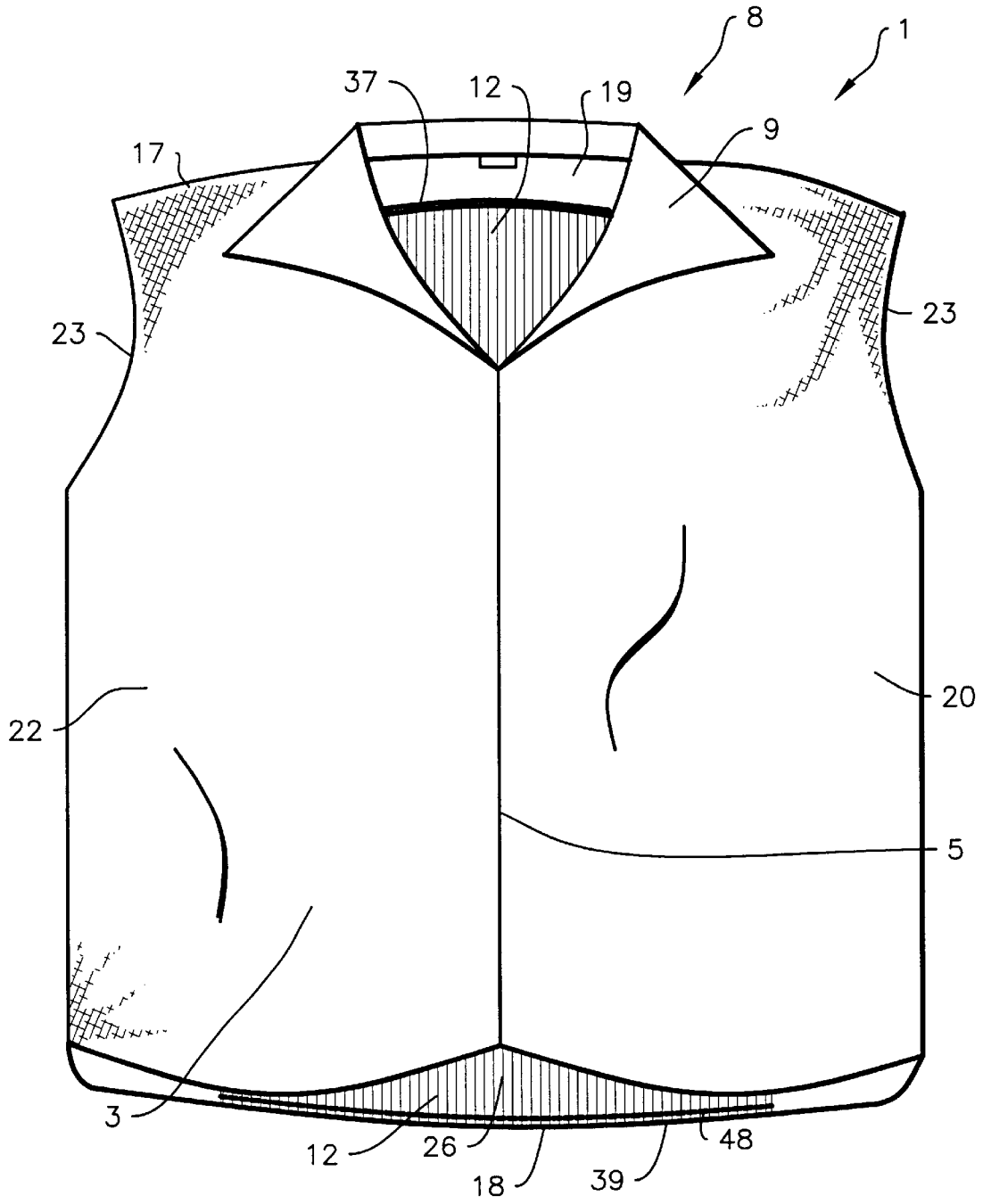
FIG. 1 is a front view of a convertible garment demonstrated as a jacket, having a jacket top and bottom, right and left sides, a neck opening and arm openings showing a sleeveless style with vertical front opening, amenable to a variety of closure devices, and collar with the blanket and pocket opening observed at the neck opening.
Figure 1A:
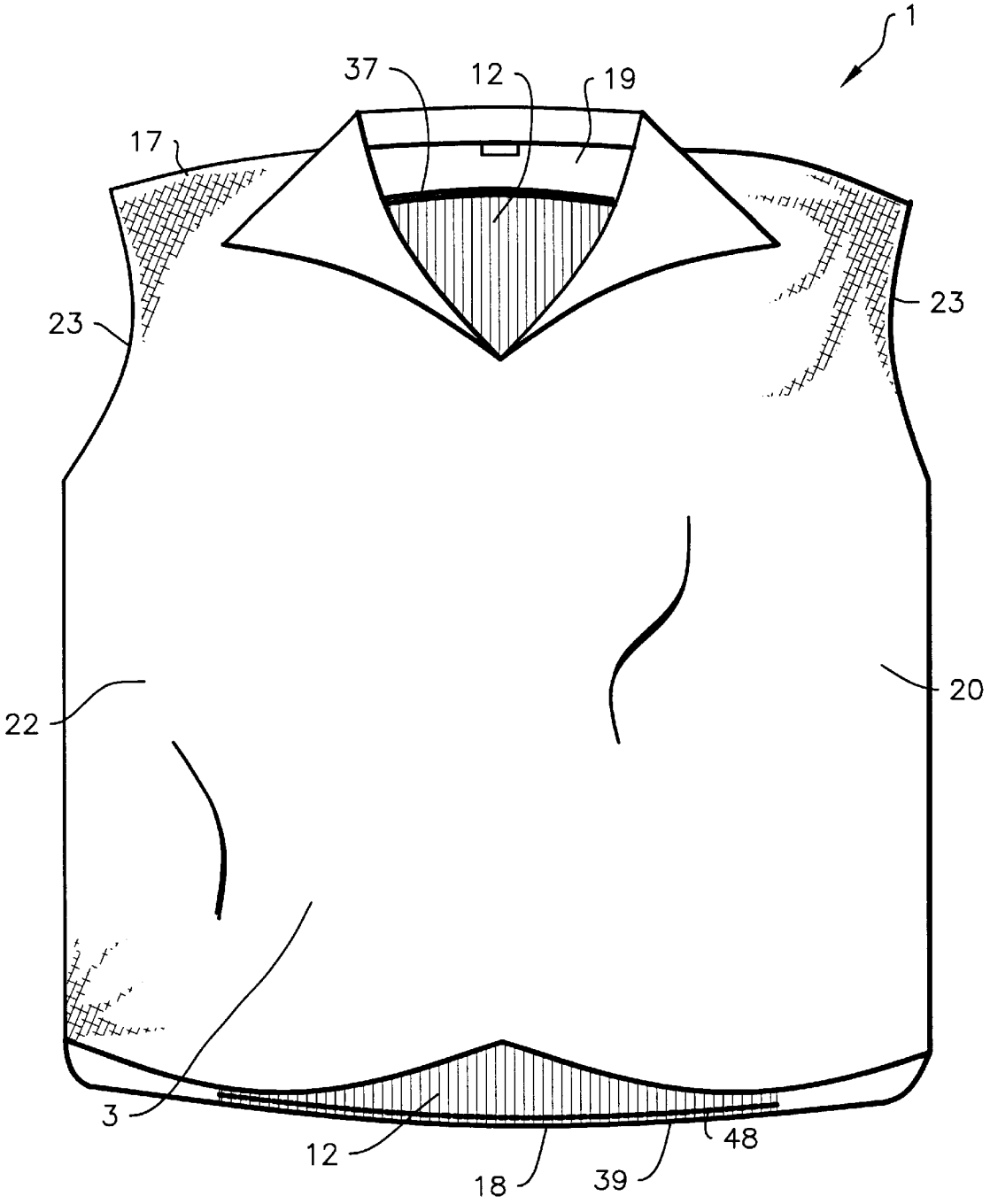
FIG. 1A is a front view of the jacket showing a sleeveless and collarless style with the blanket and pocket opening observed at the neck opening.
Figure 2:
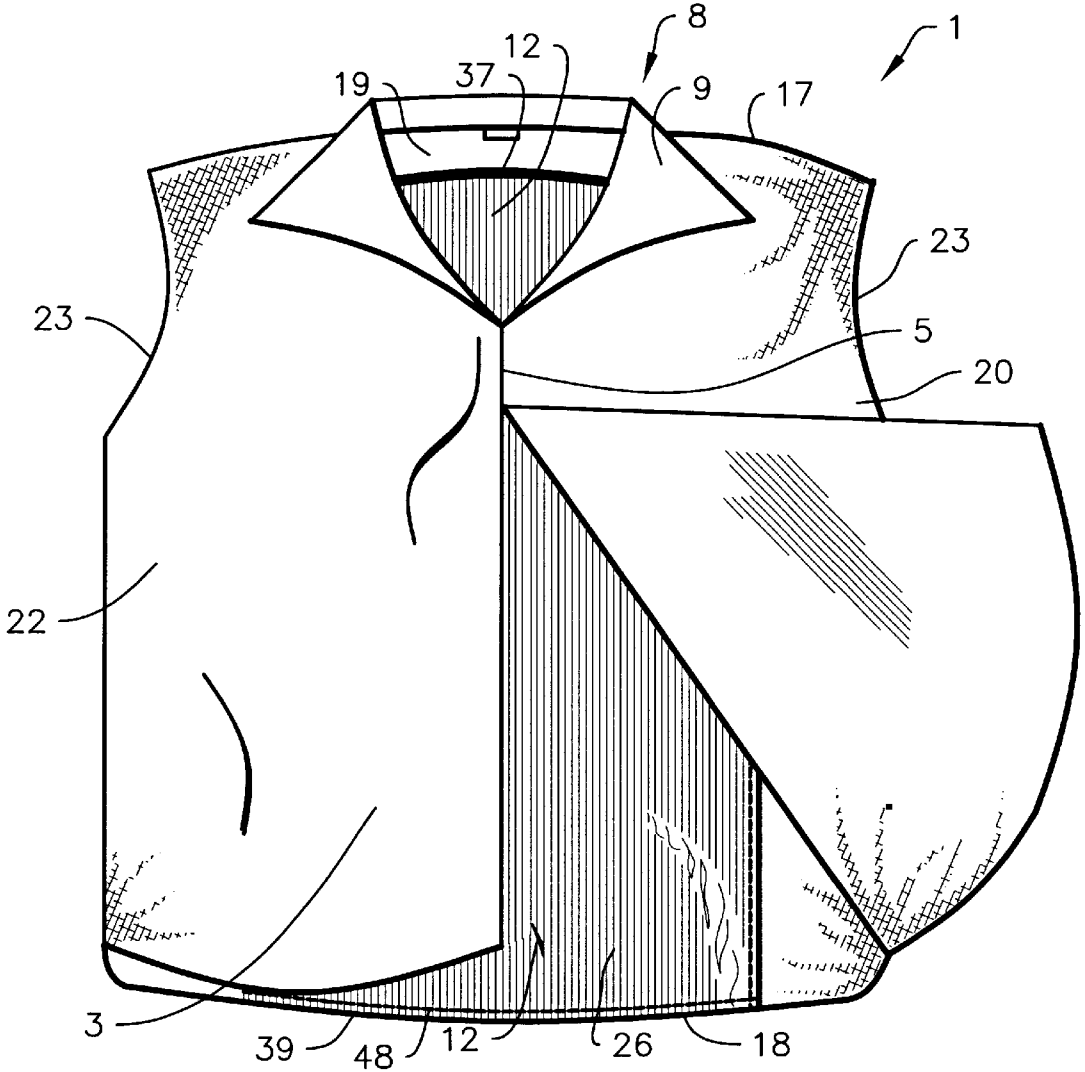
FIG. 2 shows the left side of the jacket partially opened.
Figure 2A:
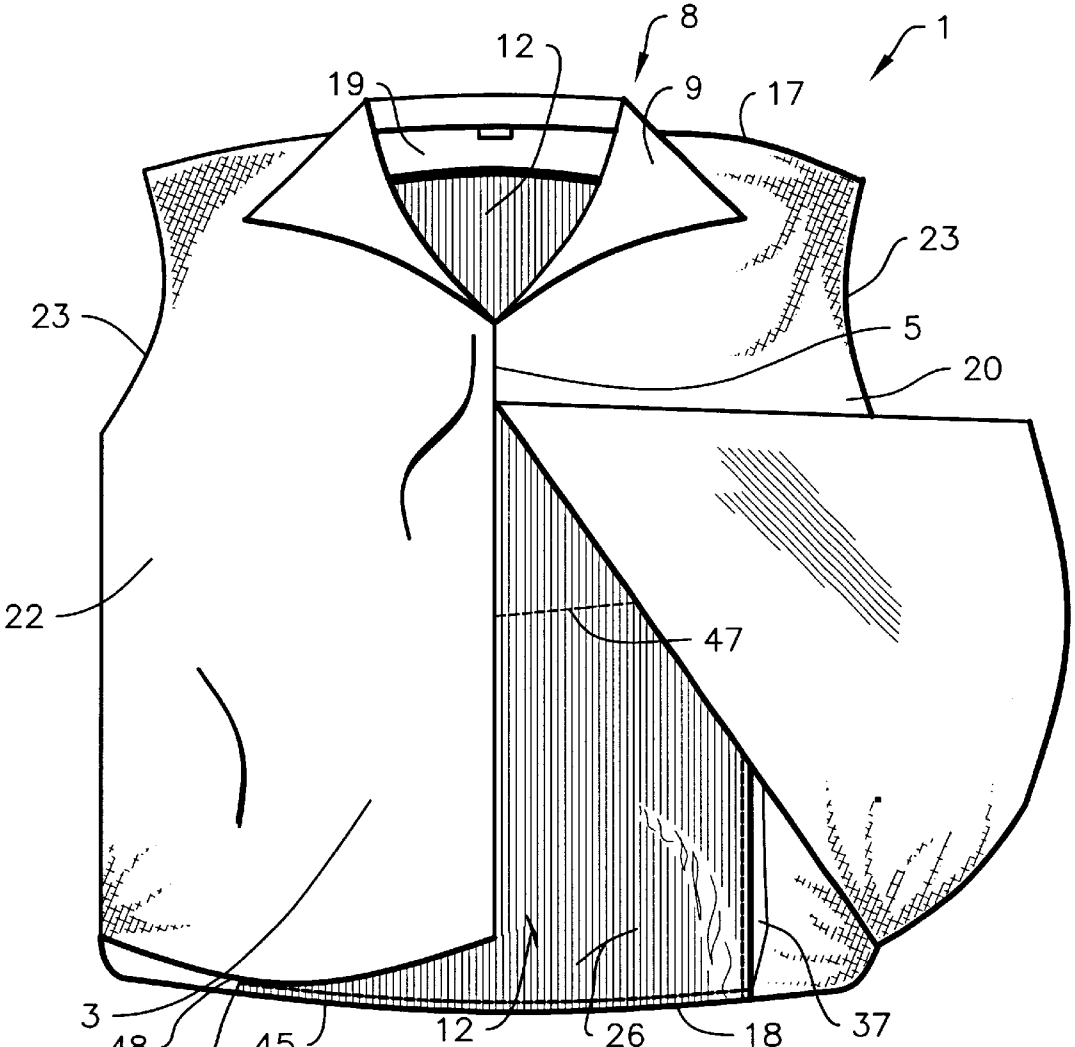
FIG. 2A shows the left side of the jacket partially opened with the pocket oriented such that the pocket is at the jacket inside and the pocket opening is proximal to the left side. Illustrated is the pocket bottom, bottom seam and left and right seam. This illustration suggests the variety of pocket orientations which are encompassed within this invention.
Figure 3:
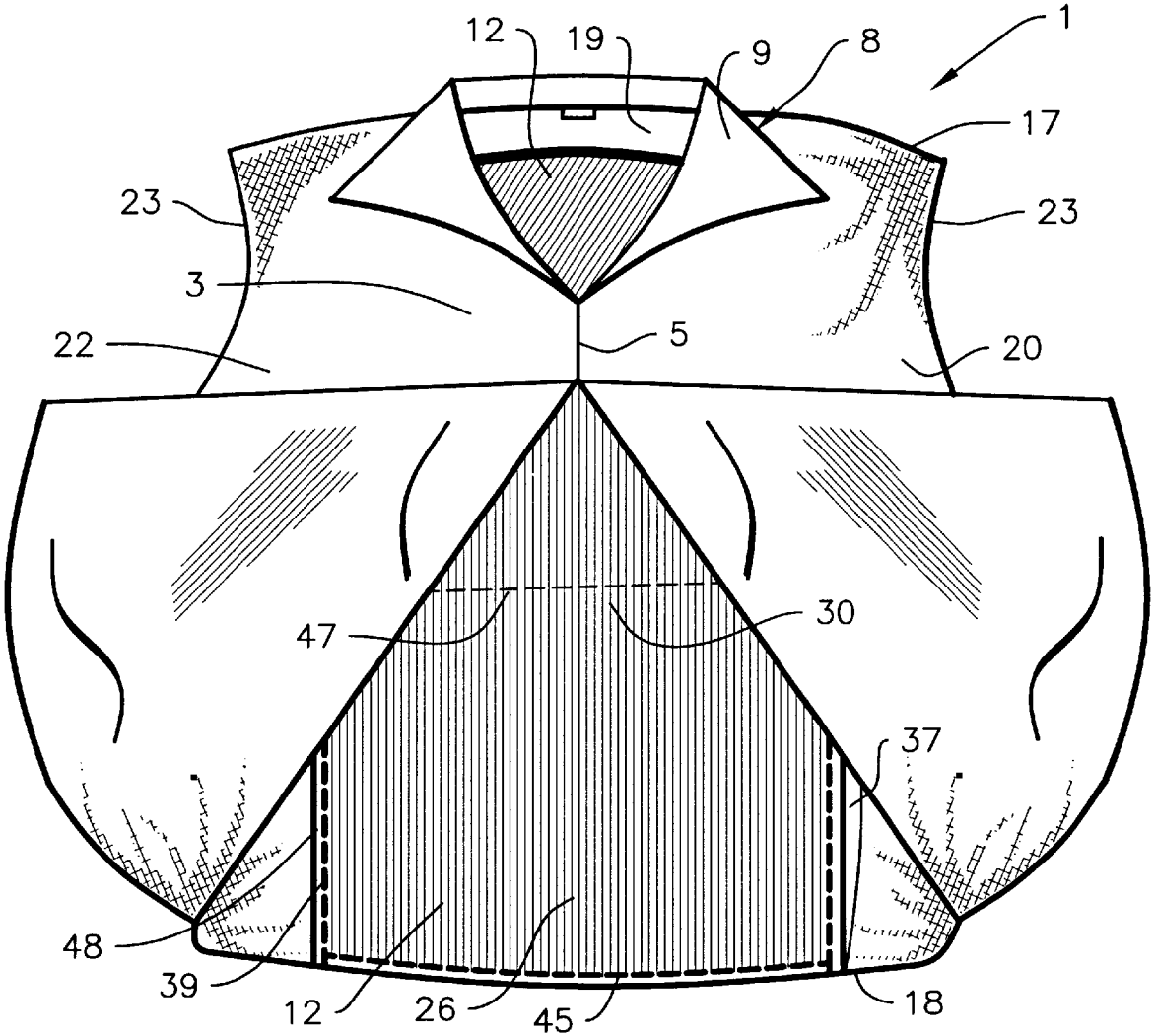
FIG. 3 illustrates the right and left sides of the jacket in partially opened positions, a pocket opening is illustrated at the inside with the pocket bottom shown at the jacket right side at the jacket inside.
Figure 4:
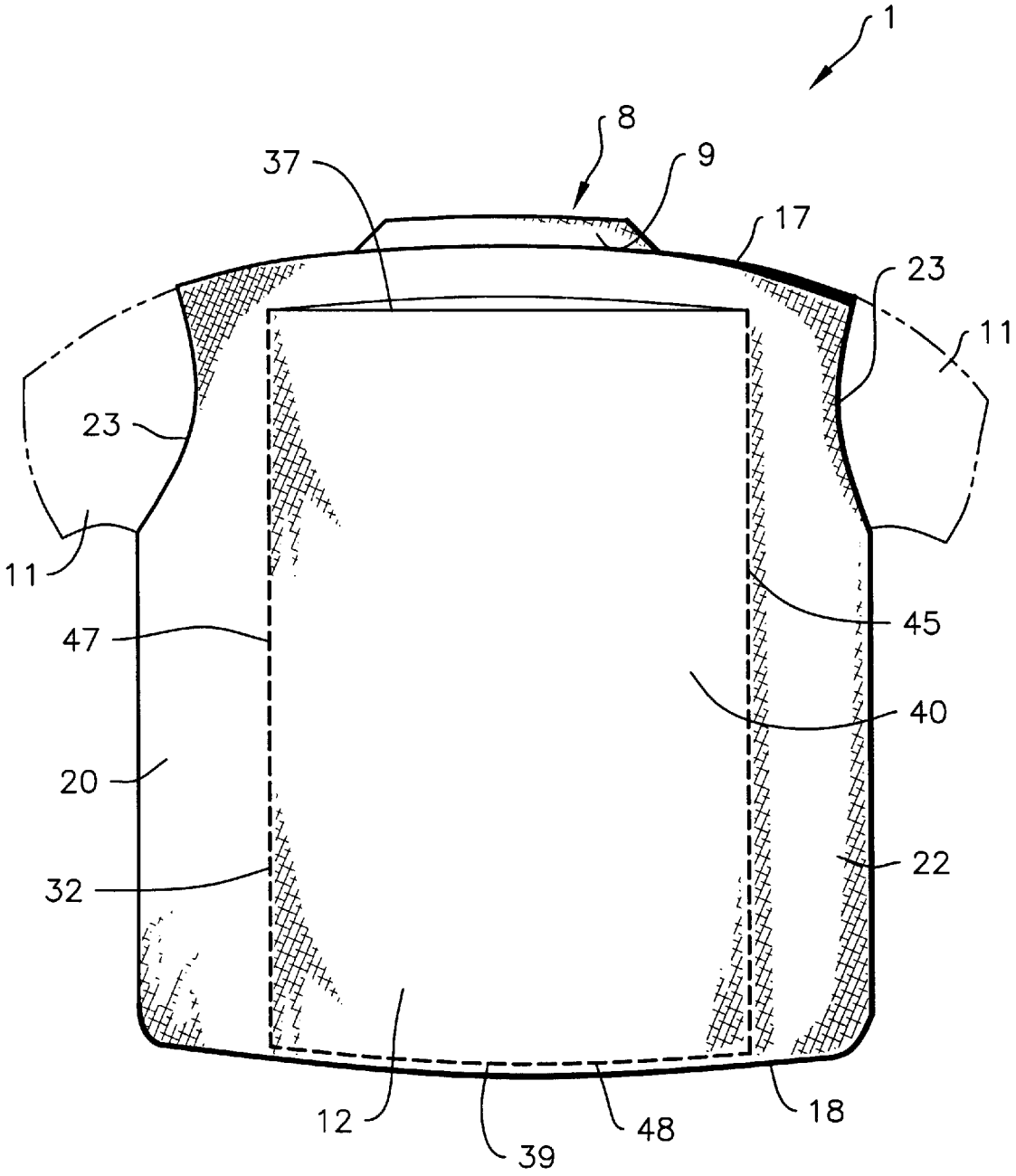
FIG. 4 shows the jacket from the back showing right and left seams, a bottom seam and pocket bottom and pocket opening at the back proximal to the jacket top.
Figure 4A:
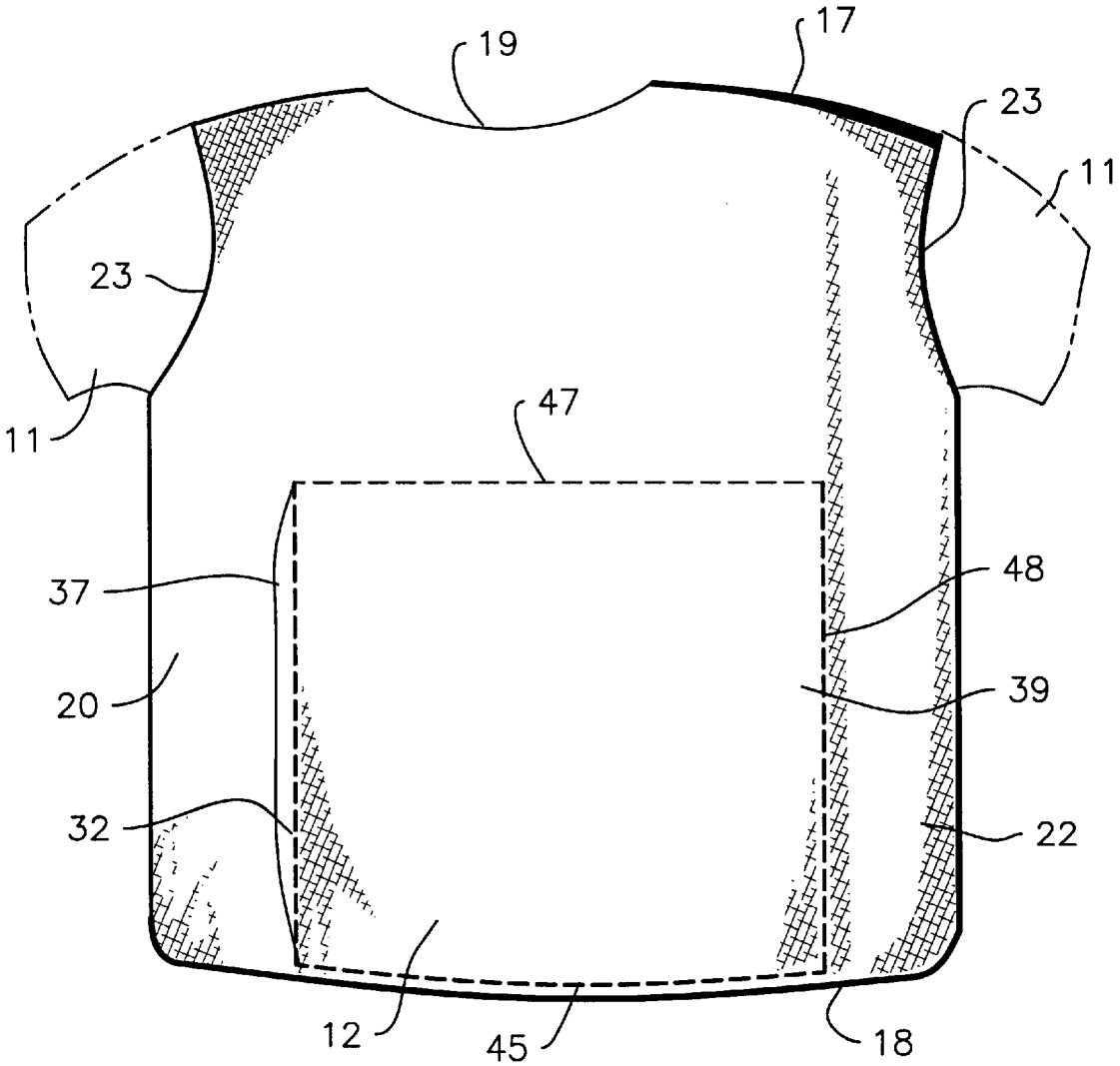
FIG. 4A shows the jacket as it would appear from either the front or back showing an alternative positioning of the pocket where the pocket opening is other than positioned proximal to the jacket top. Sleeves 11 are depicted as an alternative feature.
Figure 5:
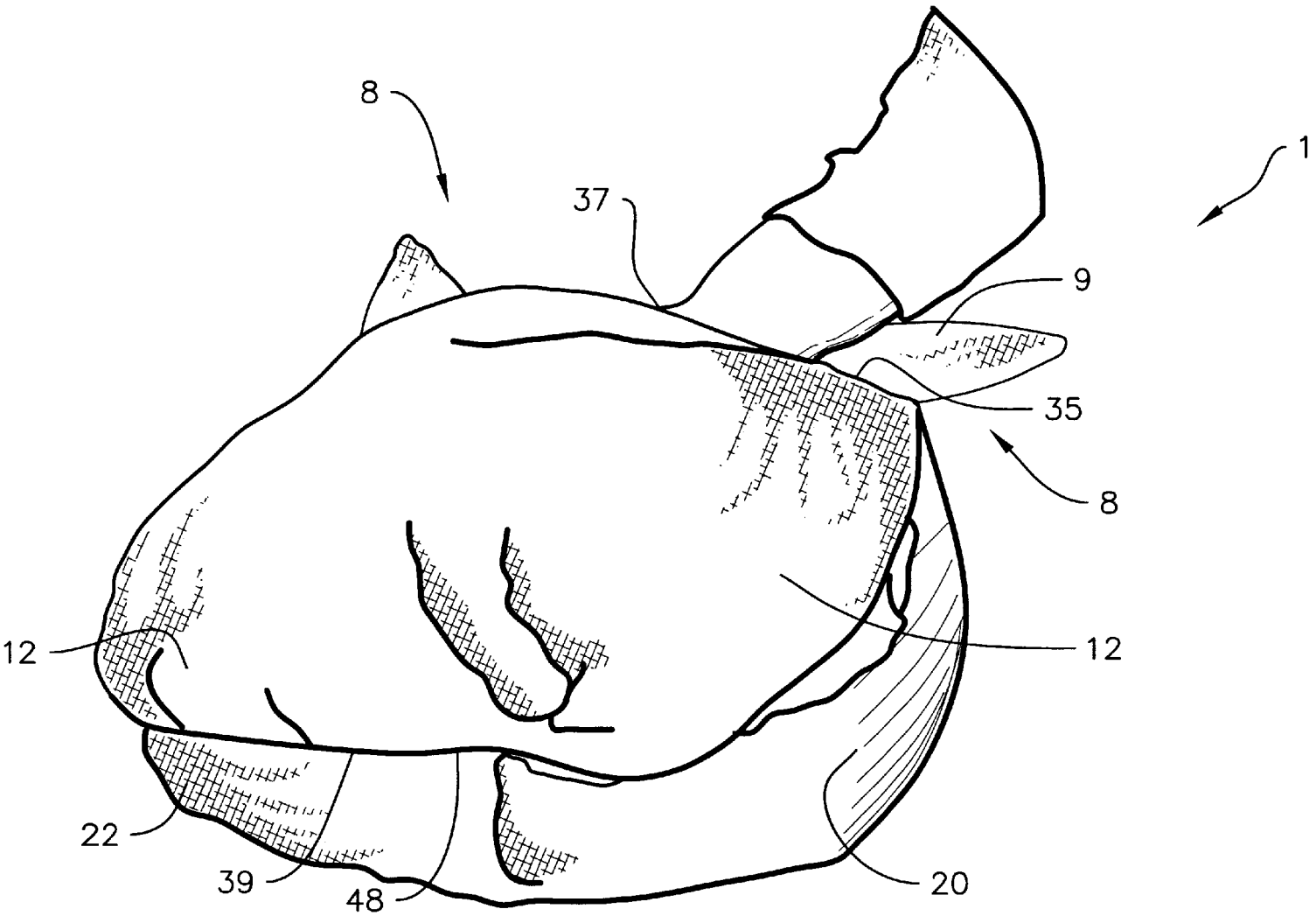
FIG. 5 commences illustrations demonstrating the steps for access to and manner of extracting and reinserting the blanket from and back into the pocket. This figure shows the blanket partially pulled out of the pocket after first reaching in through the pocket opening. This figure illustrates the pocket opening proximal to the collar front. The blanket is removed from the pocket reaching into the pocket at the pocket opening and grasping the bottom of the pocket at the pocket bottom and pulling the folded blanket through the interior of the pocket and out of the pocket opening.
Figure 6:
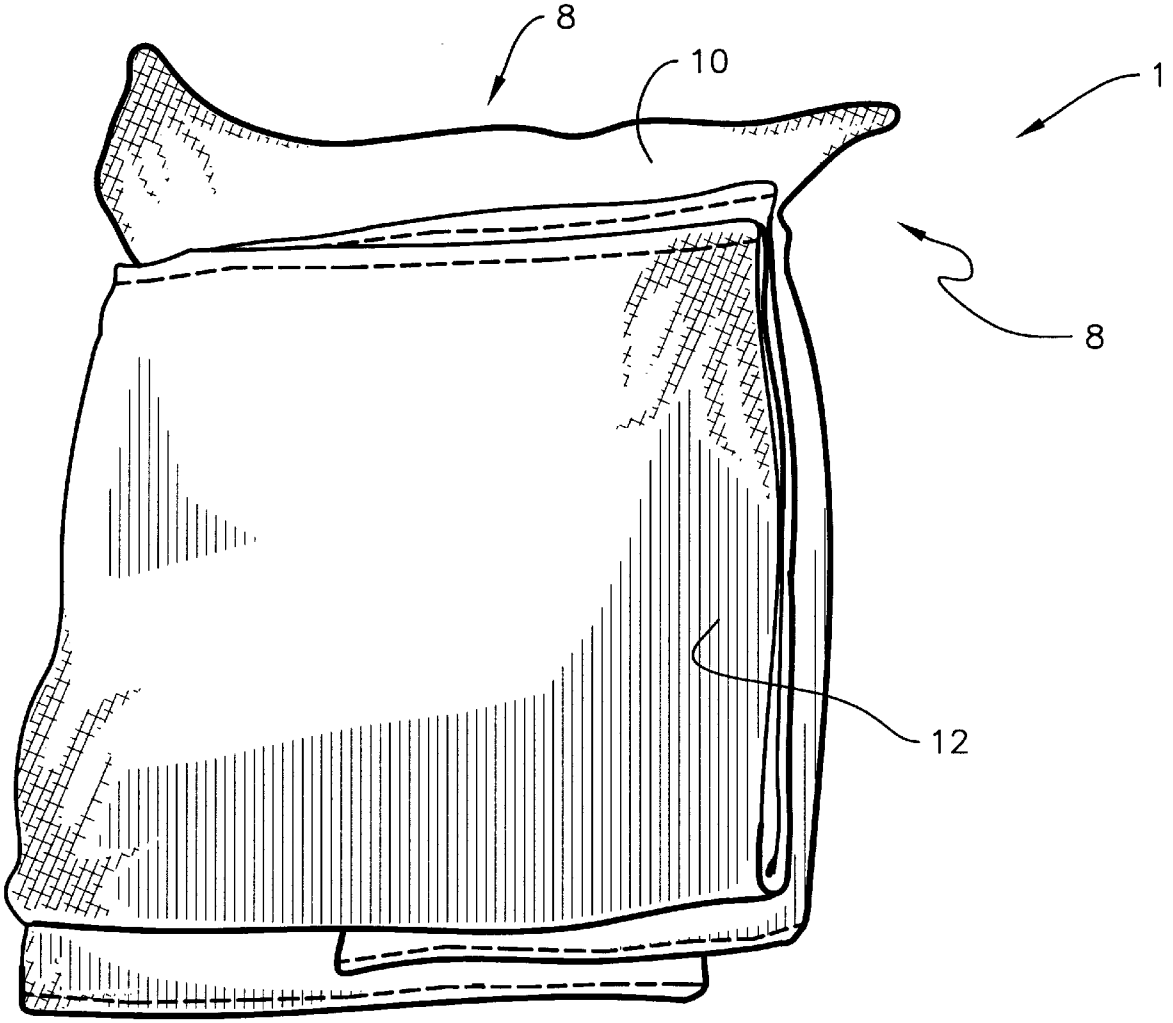
FIG. 6 shows the blanket layout after the pocket is completely pulled inside-out and the blanket flattened. The collar back is shown in this view. This illustration shows the blanket in a folded layer which was contained within the pocket.
Figure 9:
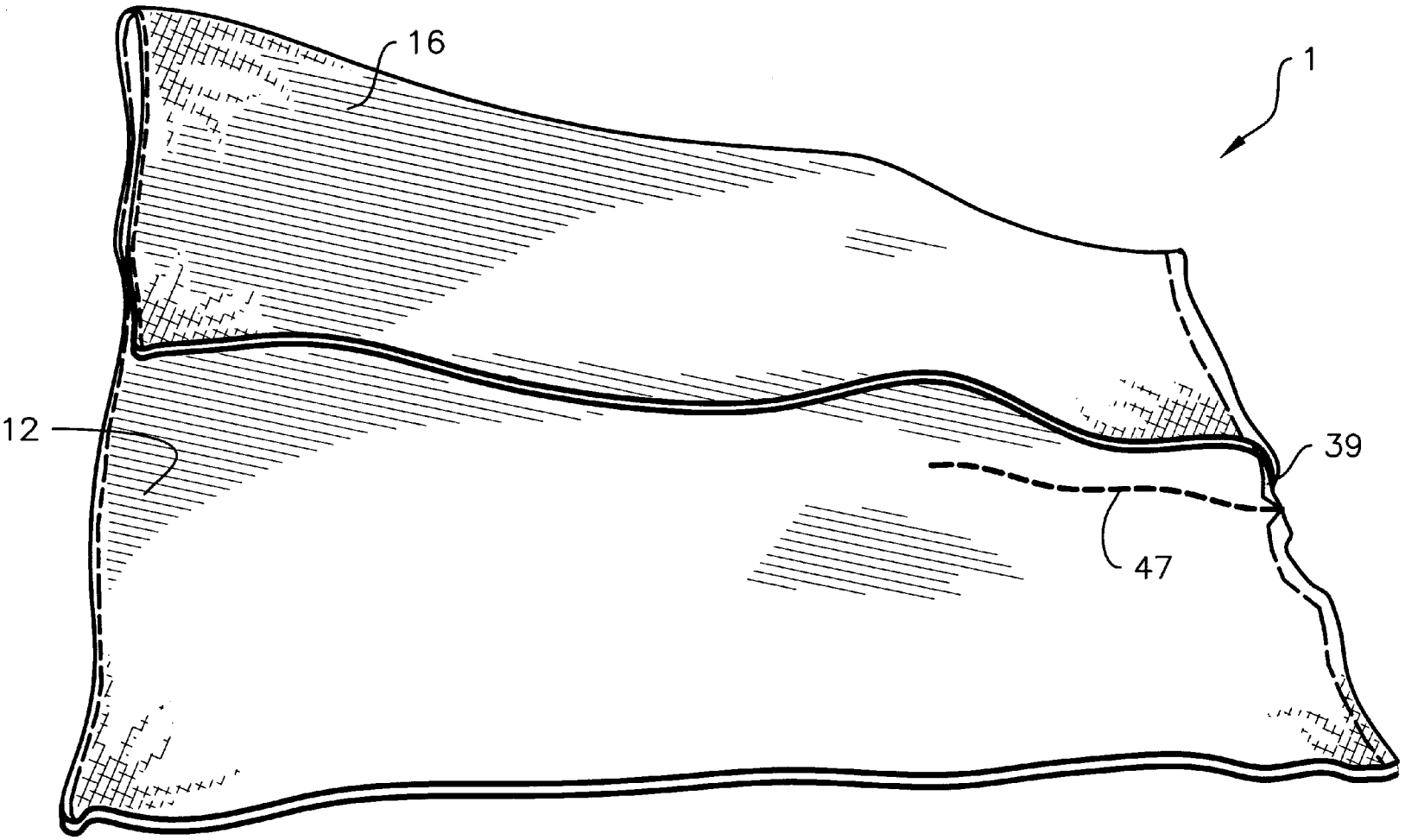
FIG. 9 shows the partial unfolding demonstrating the full-length position of the blanket which still contains folded material extending over the length of this view.
Figure 10:
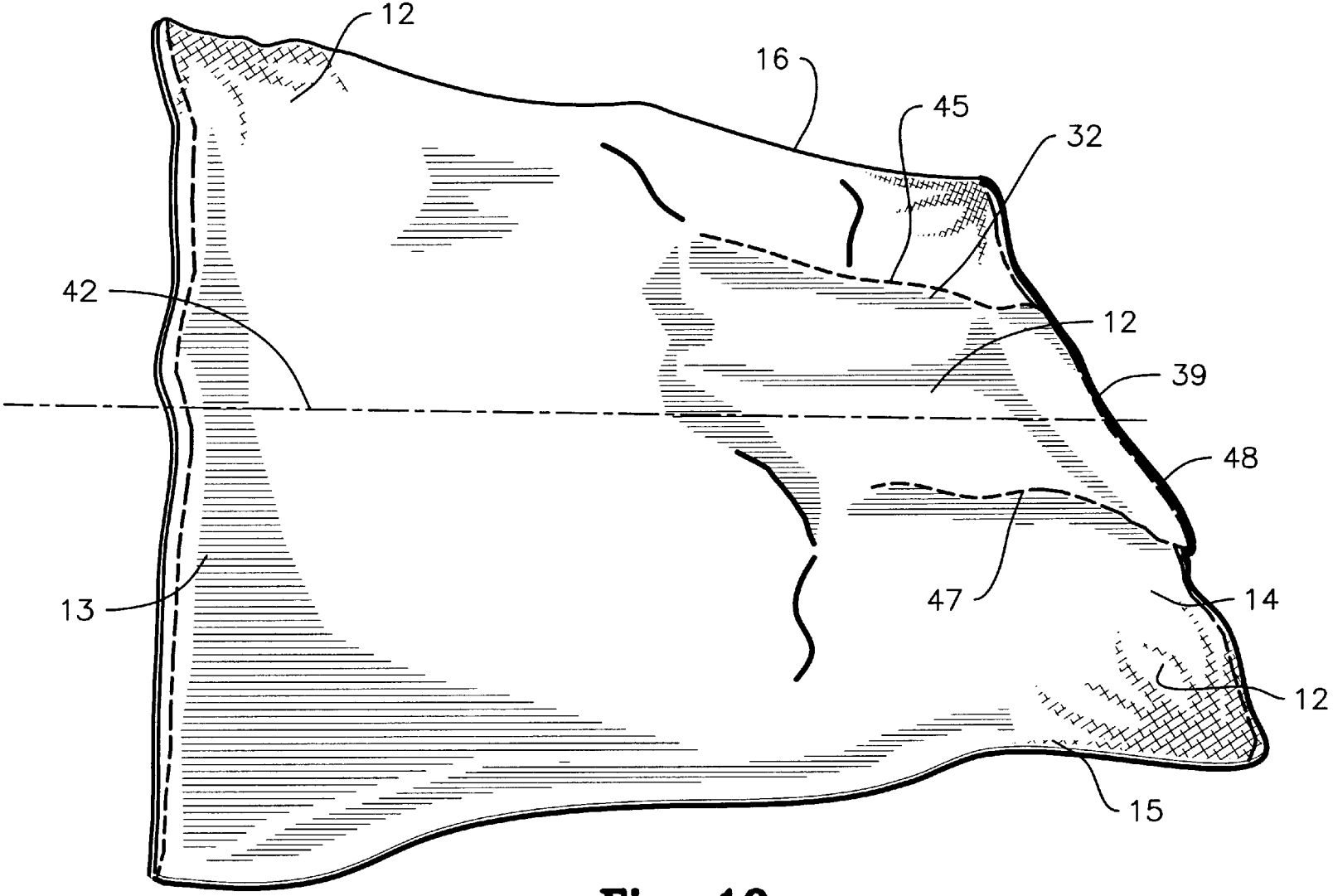
FIG. 10 illustrates the unfolding of the remaining lengthwise fold displaying the blanket in its fully opened orientation.
Figure 11:
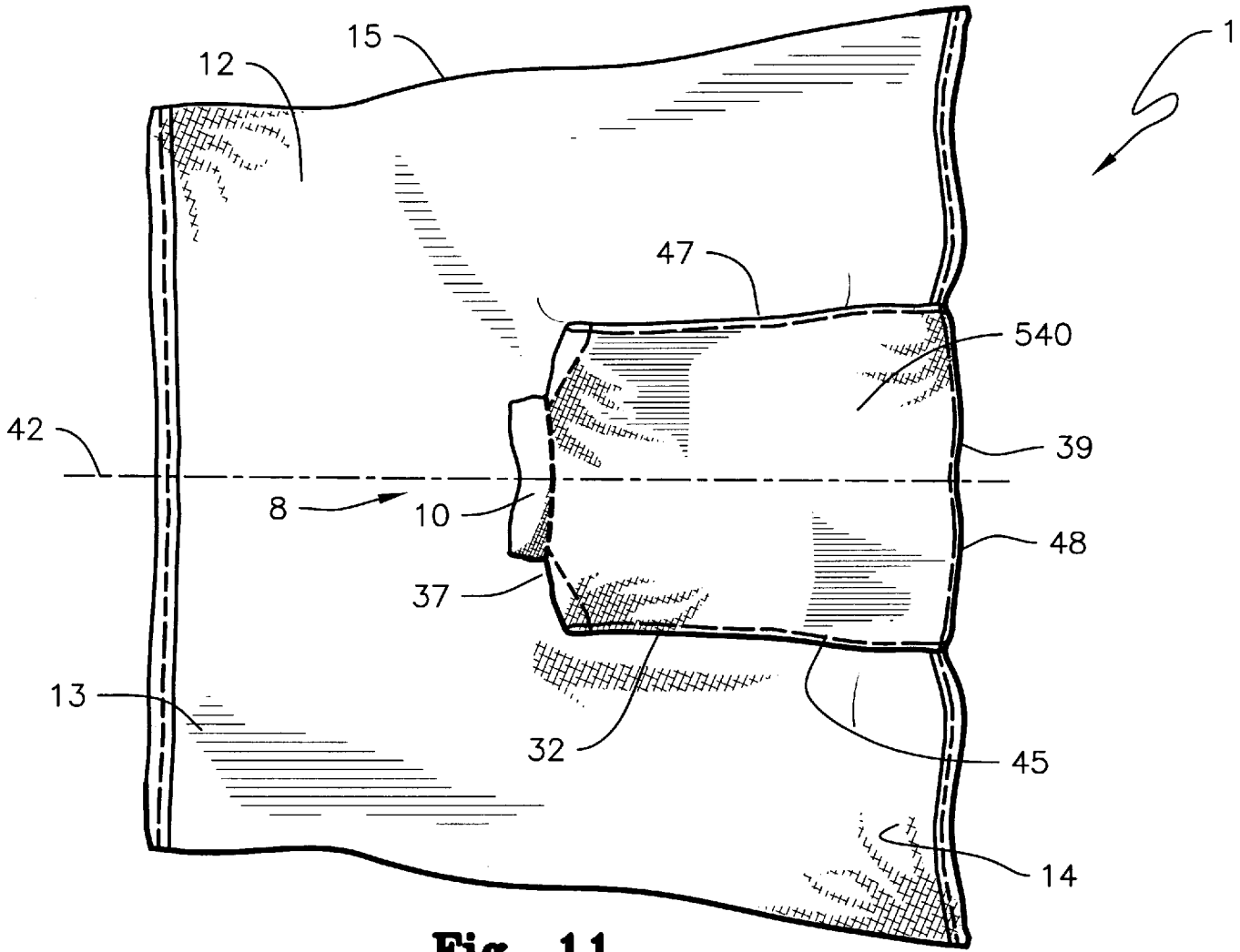
FIG. 11 shows the unfolded portion reversed and upended to demonstrate the opposite side of the view shown in FIG. 10.

The Convertible Garment 1 disclosed herein is illustrated in FIG. 1 through FIG. 12. FIG. 1 is a front view of the jacket 1 showing a sleeveless style with vertical front opening 5, amenable to a variety of closure means including but not limited to for example, VELCRO®, zippers, buttons and snaps and other closure means, and collar 8 with a blanket 12 observed at neck opening 19. The jacket 1 has a right and a left side 22, 20. The collar 8 has a collar front and a collar back 9, 10. The collar 8 is shown in FIGS. 1 through 4, 5 through 8 and 11. The collar front 9 is shown in FIGS. 1 through 4 and 5 while the collar back 10 is shown in FIGS. 6 and 11. The left side 20 of the jacket 1 is shown partially opened in FIG. 2. FIG. 3 illustrates the right and left sides 22, 20 of the jacket 1 in partially opened positions. FIG. 3 also shows the blanket 12 of the jacket 1. FIG. 4 shows the jacket 1 from the back 40 with left and right seams 45, 47 illustrating or indicating a portion of the jacket 1 structure forming the perimeter or boundary of a pocket 35 formed between the back 40 and the blanket 12. The pocket 35 has a pocket opening 37 positioned, for example in the preferred embodiment, proximal to the collar 8 at the collar front 9, as shown in FIGS. 1 through 2A, 11 and 12, and a pocket bottom 39 positioned distal from the pocket opening 37, as shown in FIGS. 1 through 5 and 11 and 12. The blanket 12 forms a portion of the pocket 35 as is shown in FIGS. 1 through 5 and 9 through 12. The blanket 12 is additionally folded into and contained within the pocket 35. The blanket 12 in the preferred embodiment is composed of a double folded layer of blanket material. However, the blanket 12 may be composed of many different fabrics or materials including but not limited to, for example, canvas and fire resistant materials, plastics and reflective materials including but not limited to mylar, blanket stock and other materials recognized by one of ordinary skills in the garment arts.

In an alternative embodiment the pocket opening 37 may be positioned proximal to the collar 8 at the collar back 10, at the jacket inside and at the jacket side. The jacket 1 may be in a vest, jacket or coat form, with or without collar or sleeves. A jacket shell or other outer garment or an inner lining may be utilized. The pocket opening 37 will be amenable to a variety of fastening or closure means including but not limited to VELCRO®, zippers, buttons and snaps and other closure means devices or methods. The pocket 35 may be oriented so that the pocket opening 37 is positioned in a multitude of orientations including, as examples without limitation, proximal to the jacket top or bottom 17, 18, proximal to the right or left 22, 20, diagonal to a vertical from the jacket top to bottom 17, 18 at the front or back 3, 40 or inside 26.

FIG. 5 is illustrative of an arm and hand having partially pulled the blanket 12 out of the pocket 35 after first reaching in through the pocket opening 37 proximal to the collar 8 at the collar front 9. The blanket 12 is removed from the pocket 35 to reveal and present a fabric or material covering. The blanket 12 is removed from the pocket 35 by inserting hands into the pocket opening 37 and grasping, at the inside of the pocket, the pocket bottom 39. The blanket 12 is extracted from the pocket 35 after extending one's arm fully into the pocket 35 via the pocket openings 37 and pulling the blanket 12 from the pocket 35. FIG. 6 shows the blanket 12 in a double folded form where the blanket 12 is completely extracted from the pocket 35 and flattened in the preferred folded configuration of this embodiment. FIG. 6 also illustrates the collar back 10 and the blanket 12 which was contained within the pocket 35.

Figure 7:
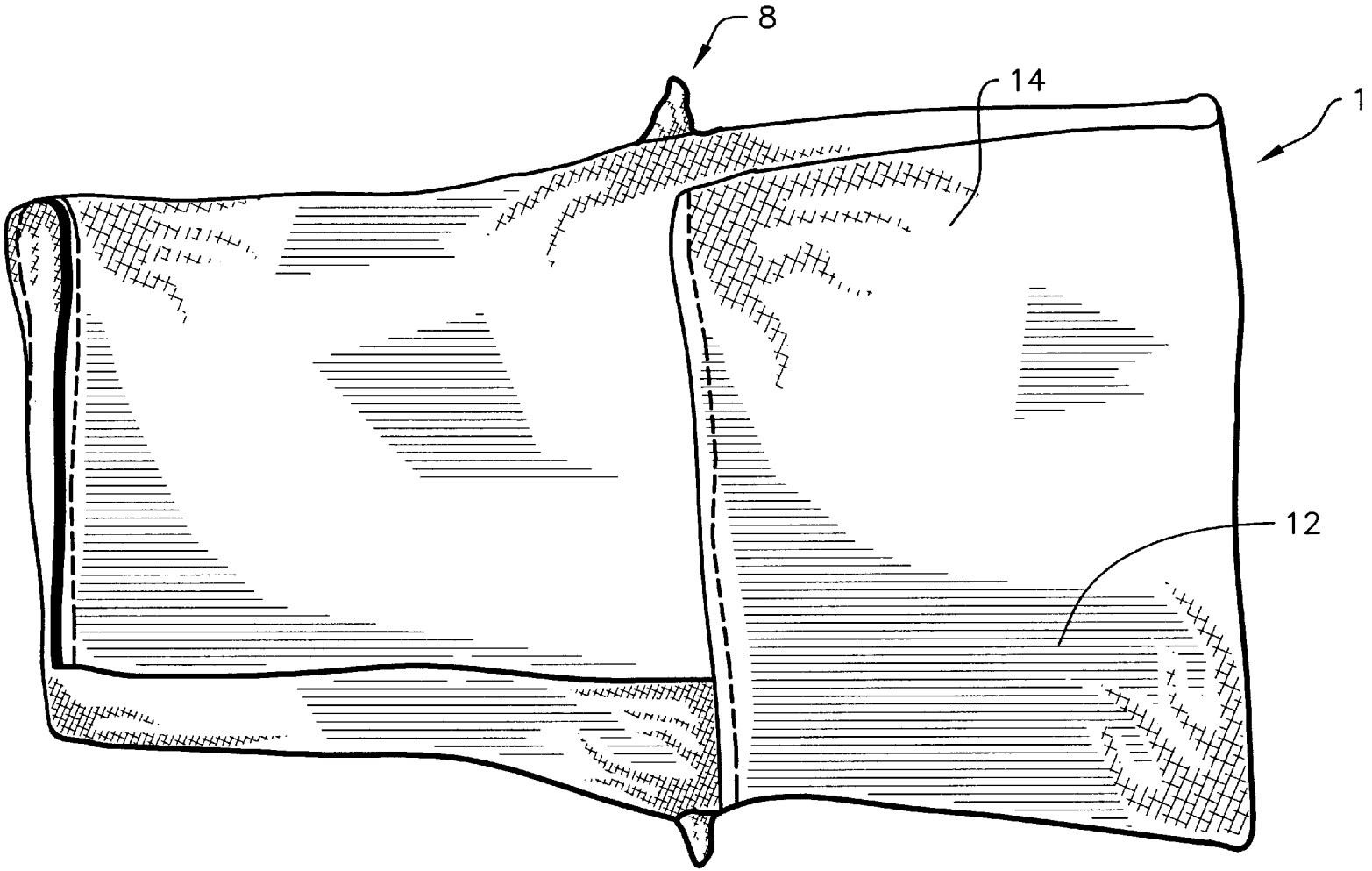
FIG. 7 illustrates the double folded blanket in a partially unfolded orientation. A remaining fold is seen in this view.
Figure 8:
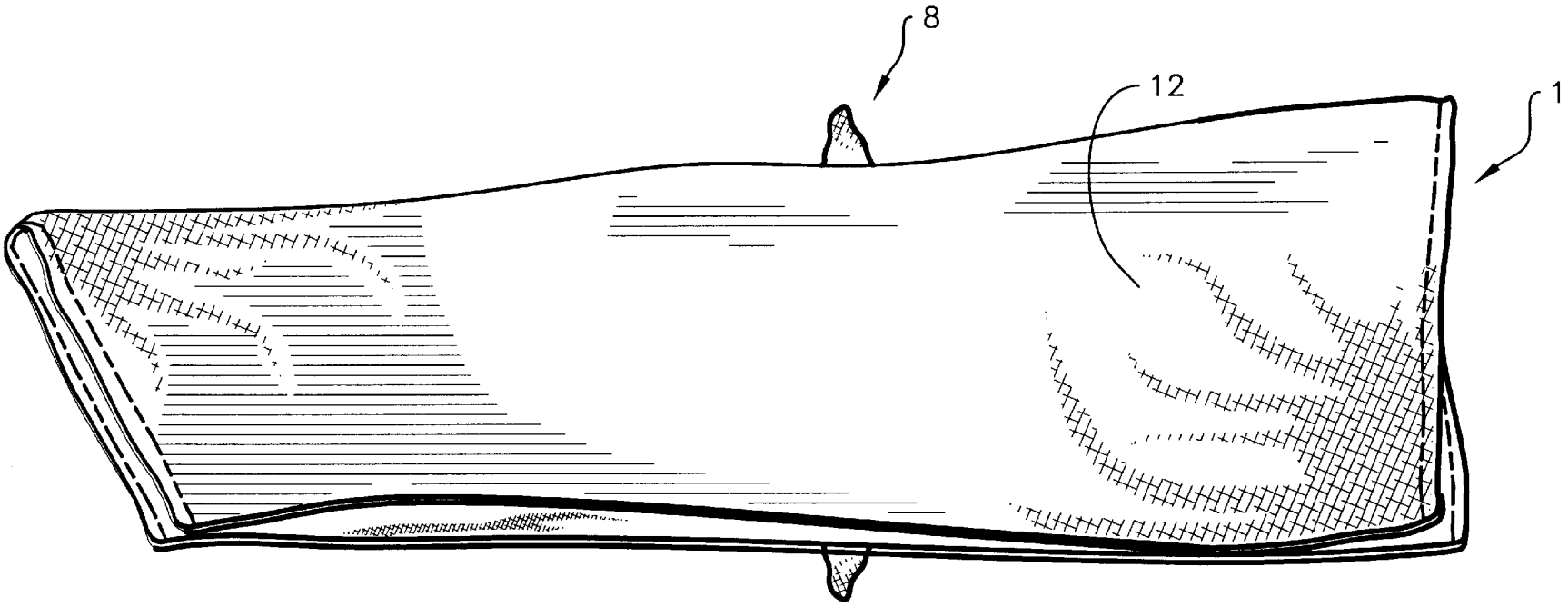
FIG. 8 illustrates the double folded blanket in a partially unfolded orientation. A remaining double folded blanket is seen in this view.
Figure 12:
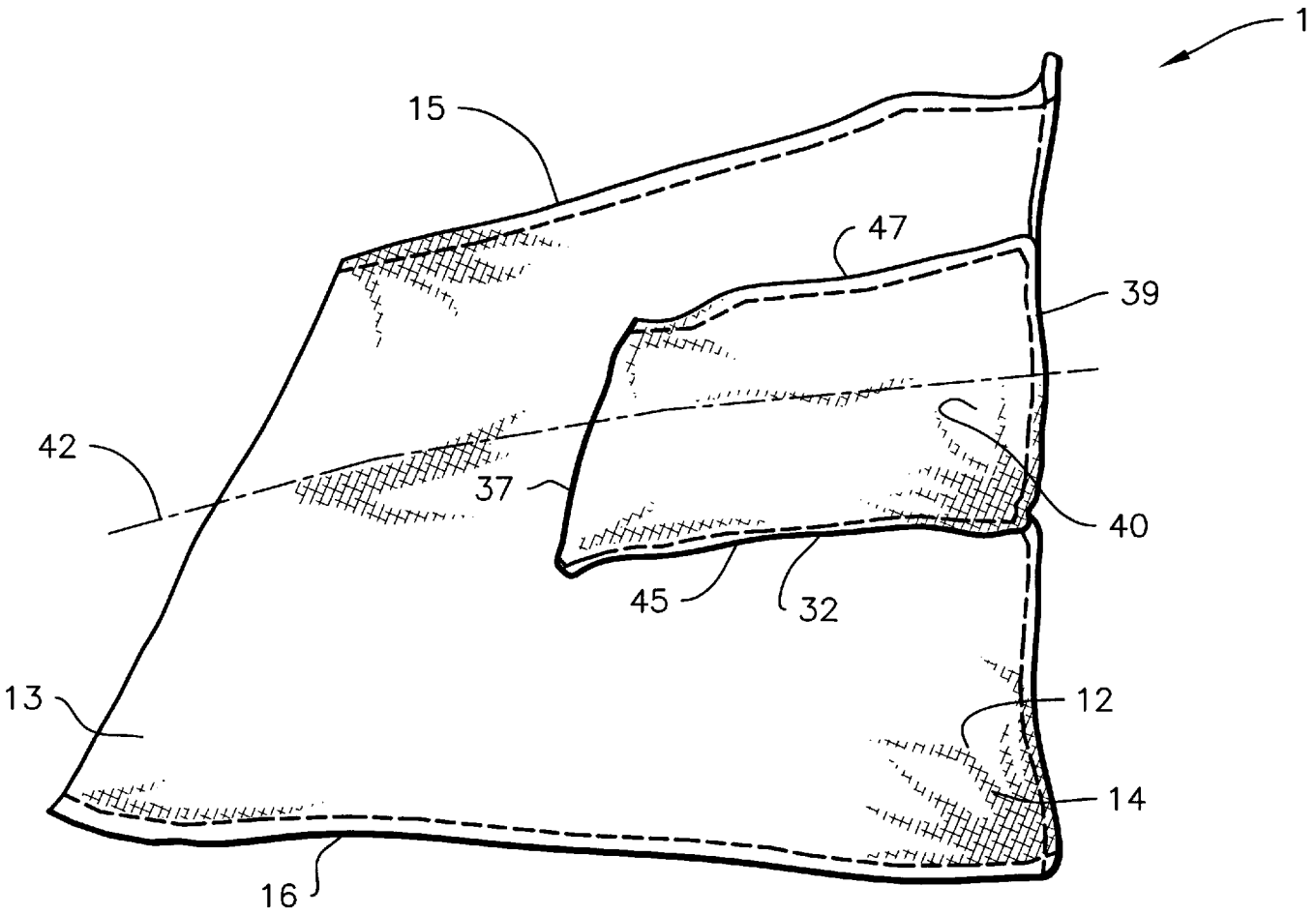
FIG. 12 shows the pocket, pocket opening and blanket seams and jacket inside with the neck collar facing downward in this view; alternatively this illustrates the circumstance where a collar is folded into the pocket; alternatively this illustrates the circumstance where a pocket is formed at the front of a jacket; alternatively, this illustrates the circumstance where a pocket is formed at the jacket inside.

FIG. 7 illustrates the blanket 12 in a partially unfolded orientation. A remaining fold 14 is demonstrated in FIG. 7. FIG. 8 shows what was depicted as a remaining fold 14, in FIG. 7, unfolded into the full-length of the blanket 12 which remains, in FIG. 8, partially folded. FIG. 9 illustrates a remaining lengthwise fold 16. FIG. 10 displays the blanket 12 in the position where the pocket 35 has been turned inside-out revealing additionally the pocket bottom 39 and the left and right seams 45, 47. FIG. 11 is a view of the blanket 12 extracted from the pocket 35 with the pocket 35 turned inside-out and bounded by the left and right seams 45, 47, the pocket opening 37, the pocket bottom 39 and the jacket back 40. FIG. 11 shows the opposite side of jacket 1 from that shown in FIG. 10. FIG. 11 additionally demonstrates the collar 8 facing downward revealing the collar back 10. FIG. 12 shows the collar 8 folded into the pocket 35 at the pocket opening 37.

The jacket 1 is returned to a jacket form by reversing the process described. The folded orientation of the blanket 12 in FIG. 6 demonstrates the position for reinsertion of the blanket 12 into the pocket 35 to return to the form of a jacket. The jacket 1 is returned to the jacket 1 form by reaching through the pocket opening 37 into the pocket 35 and grasping the pocket bottom 39 and drawing the folded blanket 12 into the pocket 35 as the pocket 35 is again turned inside-out to the position demonstrated by FIGS. 1 through 4.

The convertible garment is comprised in the elemental sense of a garment, shown here for convenience as a jacket 1, with a blanket 12 affixed by means to the jacket 1, forming a pocket 35; the blanket 12 affixed to the jacket such that portions of the blanket 12 are foldably received into the pocket 35. The jacket 1 may have a liner or a shell, be collar or collarless, sleeve or sleeveless and possess other commonly understood structures in the garment arts. The blanket 12 may be of regular geometric shapes including but not limited to square, rectangular and circular or irregular shapes. The blanket 12, for convenience, is described as having a blanket top and bottom 13, 14, a blanket right and left edge 15, 16 and a centerline 42 extending generally centrally from blanket top to blanket bottom 13, 14; the blanket 12 is affixed to the jacket 1 generally by stitching with other commonly understood affixing means appropriate including but not limited to VELCRO®, snaps, buttons, brads, glues and other affixing means. The blanket 12 is affixed to the jacket 1 in a variety of orientations including at the jacket back 40, front 3 and inside 26. The blanket 12 is affixed to the jacket 1 such that portions of the blanket 12 will be folded and received into the pocket 35 at the pocket opening 37. The blanket 12 may be affixed to the jacket 1 intermediate to the blanket right edge 15 and the centerline and intermediate to the blanket left edge 16 and the centerline and proximal to the blanket bottom 14 forming a pocket having a pocket opening proximal to the blanket top 13 and distal to the blanket bottom 14 which foldably receives, at the pocket opening 37, those portions of the blanket 12 positioned between the affixing means and the blanket right and left edges 14, 15 and between the pocket opening 37 and the blanket top 13.

The jacket 1 has an outer covering 2, a front and a back 3, 40, a jacket top and bottom 17, 18; a jacket inside 26; the jacket 1 at the front 3 has a right and a left side 22, 20; and a neck opening 19 at the jacket top 17. The blanket 12 may be affixed by means to the jacket outer covering 2 at the back 40, at the front 3 and at the inside 26.

Another description of the orientation of the blanket and jacket is found in the description of the blanket 12 as affixed by means to the jacket 1 by left and right seams 45, 47 and a bottom seam 48; the bottom seam 48 is generally orthogonal to the left and right seams, which are generally parallel, and intersecting the left and right seams 45, 47; the left and right seams 45, 47 and the bottom seam 48 fasten by affixing means to the blanket 12 to the jacket 1 forming the perimeter or boundary of a pocket 35, the pocket 35 having a pocket opening 37 and a pocket bottom 39 positioned distal from the pocket opening 37 and the bottom seam 48. Again, the blanket 12 may be affixed by means to the back 40, front 3 and inside 26. Alternatively the left and right seams 45, 47 are generally vertically formed commencing proximal to the jacket top 17 and proceeding proximal to the jacket bottom 18; the bottom seam 48 is generally horizontally formed proximal to the jacket bottom 18 at the back 40 intersecting the left and right seams 45, 47; the left and right seams 45, 47 and the bottom seam 48 fasten by means the outer covering 2 at the back 40 to the blanket 12 forming the perimeter or boundary of a pocket 35 residing between the back 40 and the blanket 12; the pocket 35 having a pocket opening 37 positioned proximal to the jacket top 17, and a pocket bottom 39 positioned distal from the pocket opening 37 proximal to the jacket bottom 18 and the bottom seam 48; the blanket 12 is folded into and contained within the pocket 35. The blanket 12 may be affixed by means to the front 3, the back 40 and/or the inside 26. In all events, the blanket 12 is folded into and contained within the pocket 35 when the jacket 1 is used and is otherwise unfolded and used as a blanket 12. It will be recognized by one of ordinary skill in the garment arts that the affixing pattern, above described as right and left seams 45, 47 and a bottom seam 48, may form other patterns including but not limited to "U" shaped and semicircular. The affixing means in the preferred embodiment is stitching. However other affixing means will suffice including but not limited to, VELCRO®, zippers, buttons, snaps, brads, glues and other affixing means recognized by one of ordinary skill in garment arts.

The jacket 1 may have a collar 8, at the neck opening 19, having a collar front and a collar back 9, 10; arm openings 23 proximal to the jacket top 17 at the right and left sides 22, 20; the outer covering 2 at the front 3 may have a center front opening 5 from the neck opening 19 to the jacket bottom 18; the center front opening 5 amenable to a variety of jacket closure means including but not limited to VELCRO®, zippers, buttons and snaps and other closure means devices or methods.

The pocket 35 may be positioned to place the pocket opening 37 proximal to the collar 8 at the collar front or back 9, 10 or proximal to the jacket top 17 at the front or back 3, 40 or inside 26. The pocket 35 may alternatively be oriented to place the pocket opening 37 toward the right or left 22, 20 or in other orientations. In any event, the blanket 12 is folded and inserted into and contained within the pocket 35.

The method of converting the garment of claim 7 comprises inserting a hand through the pocket opening 37 into the pocket 35; grasping, at the inside of the pocket, the pocket bottom 39; turning the pocket 35 inside-out revealing additionally the pocket bottom 39 and the left and right seams 45, 47; extracting the blanket 12 from the pocket 35; unfolding the blanket 12. The reverse returns the blanket 12 into the pocket 35 including folding the blanket 12, reaching through the pocket opening 37 into the pocket 35 and grasping the pocket bottom 39; drawing the folded blanket 12 into the pocket 35 as the pocket 35 is again turned inside-out to the starting position.

Alternative embodiments apply to this invention, as would be recognized by those of ordinary skill in the garments art, to articles of clothing other than jackets including for example, without limitation, overcoats, pants and trousers. The matter of the application of a pocket foldably containing a blanket or other covering is equally applicable to other articles of clothing other than upper jacket type apparel.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A convertible garment comprising:

(A) a jacket 1; a blanket 12 affixed to the jacket 1 forming a pocket 35; the blanket affixed to the jacket such that portions of the blanket are foldably received into the pocket;

(B) the blanket 12 having a blanket top and bottom 13, 14, a blanket right and left edge 15, 16 and a centerline 42 extending generally centrally from blanket top to blanket bottom 13, 14; the blanket 12 affixed to the jacket 1 intermediate to the blanket right edge 15 and the centerline and intermediate to the blanket left edge 16 and the centerline and proximal to the blanket bottom 14 forming a pocket 35 having a pocket bottom 39 and a pocket opening 37; the pocket opening 37 distal to the pocket bottom 39 and to the blanket bottom 14; the pocket 35 foldably receives those portions of the blanket 12 positioned between the affixing means and the blanket fight and left edges 14, 15 and between the pocket bottom 14 and the blanket top 13; wherein the blanket and the jacket are mutually exclusive in use.

2. The garment of claim 1 further comprising:

(A) the jacket 1 having an outer covering 2, a front and a back 3, 40, a jacket top and bottom 17, 18; a jacket inside 26; the jacket 1 at the front 3 having a right and a left side 22, 20; a neck opening 19 at the jacket top 17.

3. The garment of claim 2 further comprising:

(B) the blanket 12 affixed by means to the jacket outer covering 2 at the back 40.

4. The garment of claim 2 further comprising:

(A) the blanket 12 affixed by means to the jacket outer covering 2 at the front 3.

5. The garment of claim 2 further comprising:

(A) the blanket 12 affixed by means to the jacket at the inside 26.

6. The garment of claim 2 further comprising:

(A) the blanket 12 affixed to the jacket 1 by left and right seams 45, 47 and a bottom seam 48; bottom seam 48 is generally orthogonal to the left and right seams, which are generally parallel, and intersecting the left and right seams 45, 47; the left and right seams 45, 47 and the bottom seam 48 fasten by affixing means the blanket 12 to the jacket 1 forming the perimeter of a pocket 35, the pocket 35 having a pocket opening 37 and a pocket bottom 39 positioned distal from the pocket opening 37 and the bottom seam 48.

7. The garment of claim 6 further comprising:

(A) the blanket 12 affixed by means to the back 40.

8. The garment of claim 7 further comprising:

(A) the blanket affixed by left and right seams 45, 47 and a bottom seam 48.

9. The garment of claim 8 further comprising:

(A) the left and right seams 45, 47 are generally vertically formed commencing proximal to the jacket top 17 and proceeding proximal to the jacket bottom 18; the bottom seam 48 is generally horizontally formed proximal to the jacket bottom 18 at the back 40 intersecting the left and right seams 45, 47; the left and right seams 45, 47 and the bottom seam 48 fasten by means to the outer covering 2 at the back 40 to the blanket 12 forming the perimeter of a pocket 35 residing between the back 40 and the blanket 12;

(B) the pocket 35 having a pocket opening 37 positioned proximal to the jacket top 17, and a pocket bottom 39 positioned distal from the pocket opening 37 proximal to the jacket bottom 18 and the bottom seam 48; the blanket 12 is folded into and contained within the pocket 35.

10. The garment of claim 6 further comprising:

(A) the blanket 12 affixed by means to the front 3.

11. The garment of claim 10 further comprising:

(A) the blanket affixed by left and right seams 45, 47 and a bottom seam 48.

12. The garment of claim 11 further comprising:

(A) the left and right seams 45, 47 are generally vertically formed commencing proximal to the jacket top 17 and proceeding proximal to the jacket bottom 18; the bottom seam 48 is generally horizontally formed proximal to the jacket bottom 18 at the front 3 intersecting the left and right seams 45, 47; the left and right seams 45, 47 and the bottom seam 48 fasten by means to the outer covering 2 at the front 3 to the blanket 12 forming the perimeter of a pocket 35 residing between the front 3 and the blanket 12;

(B) the pocket 35 having a pocket opening 37 positioned proximal to jacket top 17, and a pocket bottom 39 positioned distal from the pocket opening 37 proximal to the jacket bottom 18 and the bottom seam 48; the blanket 12 is folded into and contained within the pocket 35.

13. The garment of claim 6 further comprising:

(A) the blanket 12 affixed by means to the inside 26.

14. The garment of claim 13 further comprising:

(A) Lathe blanket affixed by left and right seams 45, 47 and a bottom seam 48.

15. The garment of claim 14 further comprising:

(A) the left and right seams 45, 47 are generally vertically formed commencing proximal to the jacket top 17 and proceeding proximal to the jacket bottom 18; the bottom seam 48 is generally horizontally formed proximal to the jacket bottom 18 at the inside 26 intersecting the left and right seams 45, 47; the left and right seams 45, 47 and the bottom seam 48 fasten by means to the outer covering 2 at the inside 26 to the blanket 12 forming the perimeter of a pocket 35 residing between the inside 26 and the blanket 12;

(B) the pocket 35 having a pocket opening 37 positioned proximal to the jacket top 17, and a pocket bottom 39 positioned distal from the pocket opening 37 proximal to the jacket bottom 18 and the bottom seam 48; the blanket 12 is folded into and contained within the pocket 35.

16. The garment of claim 9 further comprising:

(A) the jacket 1 having a collar 8, at the neck opening 19, having a collar front and a collar back 9, 10; arm openings 23 proximal to the jacket top 17 at the right and left sides 22, 20; the outer covering 2 at the front 3 having a center front opening 5 from the neck opening 19 to the jacket bottom 18; the center front opening 5 amenable to a variety of closure means;

(B) the pocket 35 having a pocket opening 37 positioned proximal to the collar 8 at the collar back 10, and a pocket bottom 39 positioned distal from the pocket opening 37 proximal to the jacket bottom 18 and the bottom seam 48; the blanket 12 is folded into and contained within the pocket 35.

17. The garment of claim 15 further comprising:

(A) the jacket 1 having a collar 8, at the neck opening 19, having a collar front and a collar back 9, 10; arm openings 23 proximal to the jacket top 17 at the right and left sides 22, 20; the outer covering 2 at the front 3 having a center front opening 5 from the neck opening 19 to the jacket bottom 18; the center front opening 5 amenable to a variety of closure means;

(D) the pocket 35 having a pocket opening 37 positioned proximal to the collar 8 at the collar front 9, and a pocket bottom 39 positioned distal from the pocket opening 37 proximal to the jacket bottom 18 and the bottom seam 48; the blanket 12 is folded into and contained within the pocket 35.

18. A convertible garment comprising:

(A) a garment; a blanket having at least one edge 12 affixed to the garment, forming a pocket 35; the blanket affixed to the garment approximate the edge and intermediate of the blanket such that portions of the blanket are foldably received into the pocket;

wherein the blanket and the jacket are mutually exclusive in use.

19. The garment of claim 18 further comprising:

(A) the blanket 12 having a blanket top and bottom 13, 14, a blanket right and left edge 15, 16 and a centerline 42 extending generally centrally from blanket top to blanket bottom 13, 14; the blanket affixed to the garment intermediate to the blanket right edge 15 and the centerline and intermediate to the blanket left edge 16 and the centerline and proximal to the blanket bottom 14 forming a pocket having a pocket opening proximal to the blanket top 13 and distal to the blanket bottom 14 which foldably receives, at the pocket opening 37, those portions of the blanket 12 positioned between the affixing means and the blanket right and left edges 14, 15 and between the pocket opening 37 and the blanket top 13.

20. The method of converting the garment of claim 6 comprising:

(A) inserting a hand through the pocket opening 37 into the pocket 35;

(B) grasping, at the inside of the pocket, the pocket bottom 39;

(C) turning the pocket 35 inside-out revealing additionally the pocket bottom 39 and the left and right seams 45, 47; extracting the blanket 12 from the pocket 35;

(D) unfolding the blanket;

(E) folding the blanket;

(F) reaching through the pocket opening 37 into the pocket 35 and grasping the pocket bottom 39;

(G) drawing the folded blanket 12 into the pocket 35 as the pocket 35 is again turned inside-out to the starting position.

* * * * *